US006697454B1

(12) United States Patent
Nicolich et al.

(10) Patent No.: US 6,697,454 B1
(45) Date of Patent: Feb. 24, 2004

(54) X-RAY ANALYTICAL TECHNIQUES APPLIED TO COMBINATORIAL LIBRARY SCREENING

(75) Inventors: Jeffrey P. Nicolich, Albany, NY (US); David M. Gibson, Voorheesville, NY (US)

(73) Assignee: X-Ray Optical Systems, Inc., East Greenbush, NY (US)

( * ) Notice: Subject to any disclaimer, the term of this patent is extended or adjusted under 35 U.S.C. 154(b) by 0 days.

(21) Appl. No.: 09/607,113

(22) Filed: Jun. 29, 2000

(51) Int. Cl.[7] ..... G21K 1/06
(52) U.S. Cl. ..... 378/85; 378/48
(58) Field of Search ..... 378/84, 85, 208, 378/44, 45, 48, 29, 88

(56) References Cited

U.S. PATENT DOCUMENTS

| | | | | |
|---|---|---|---|---|
| 5,880,467 A | | 3/1999 | Martinis et al. | 250/310 |
| 5,923,720 A | | 7/1999 | Barton et al. | 378/84 |
| 5,959,297 A | | 9/1999 | Weinberg et al. | 250/288 |
| 6,030,917 A | | 2/2000 | Weinberg et al. | 502/104 |
| 6,034,775 A | * | 3/2000 | McFarland et al. | 356/364 |
| 6,054,047 A | | 4/2000 | Hindsgaul et al. | 210/198.2 |

FOREIGN PATENT DOCUMENTS

| | | | |
|---|---|---|---|
| WO | WO 92/10092 | 6/1992 | A01N/1/02 |

* cited by examiner

*Primary Examiner*—Edward J. Glick
*Assistant Examiner*—Hoon Song
(74) *Attorney, Agent, or Firm*—Kevin P. Radigan; Heslin Rothenberg Farley & Mesiti P.C.

(57) ABSTRACT

An x-ray apparatus and method are presented for controlling x-rays to analyze combinatorial libraries for the rapid screening of different materials and different conditions. The apparatus includes a laboratory x-ray source, one or more x-ray optics, a combinatorial library, and a detector such as an x-ray detector or an electron energy detector. The apparatus can be used to perform analytical measurements on individual members of the library, where the measurements may comprise x-ray fluorescence, x-ray diffraction, total reflection x-ray fluorescent spectrometry, and/or extended x-ray absorption fine structure.

32 Claims, 6 Drawing Sheets

X-RAY ANALYTICAL TECHNIQUES APPLIED TO COMBINATORIAL LIBRARY SCREENING

TECHNICAL FIELD

The present invention relates generally to methods and apparatus for rapidly screening an array of diverse materials that have been created, for example, on a single substrate surface. More specifically, the invention is directed to optical techniques for screening libraries of different materials.

BACKGROUND OF THE INVENTION

Combinatorial synthesis is the approach of creating extensive libraries of diverse samples by combining a set of components in many possible ways. The approach has been very successfully demonstrated for chemical compounds. Many classes of libraries can be generated combinatorially including inorganics, intermetallics, metal alloys and ceramics. Various surface deposition techniques, masking techniques and processing conditions allow a few to hundreds of thousands of materials with distinct compositions to be generated per square inch. Fields where combinatorial synthesis is important include pharmaceuticals, electrical engineering, chemistry, materials science, earth science, engineering and other related fields.

Techniques known in the art for rapid screening of libraries of diverse materials include: detecting changes in polarization associated with orientational order, dielectric coefficient, or magnetization; infrared imaging to identify active catalysts; photon scattering for the analysis of molecular weight and gas chromatography/mass spectroscopy (GC/MS). Gas chromatography and high-throughput detection are employed to identify and characterize gas phase products or volatile components, and mass spectroscopy is a method in analytical chemistry for the identification of chemical species. U.S. Pat. No. 6,034,775, which is hereby incorporated herein by reference in its entirety, gives an overview of synthesis techniques and optical screening techniques.

DISCLOSURE OF THE INVENTION

While the above techniques are useful, there are few, if any, techniques for rapid screening of libraries for characteristics such as crystalline phase or elemental composition, and which are easily identified with x-ray analysis. In addition, many of the optical techniques described above are destructive. For example, members of a library may be heated and measurements performed on what volatizes off of the members. Thus, it is desirable to have techniques for rapid large scale screening of combinatorial libraries using x-ray analytical techniques. X-rays provide information that other techniques do not and x-ray analysis is non-destructive allowing the libraries to be referred to and tested more than once.

Typically, when an interesting chemical combination is found in a combinatorial library, bulk samples of the compound are made for x-ray analysis. This process is both time consuming and limited because members of the library may be overlooked. In addition, the X-ray sources used in the evaluation of bulk samples are large high power sealed tubes (~few kilowatts) or rotating anode sources. These sources are large, require water cooling and high voltage and are very expensive. Thus, there is a need for x-ray analysis of a combinatorial library directly using low power (approximately less than a few hundred watts) X-ray laboratory sources to increase efficiency, reduce measurement time, and increase thoroughness of evaluation.

Currently, in limited cases combinatorial libraries have been analyzed using synchrotron x-ray sources. While synchrotron radiation has some distinct advantages, there are a number of drawbacks. Access to synchrotron sources is limited and expensive. The cost of a synchrotron facility is on the order of $100M. Synchrotron facilities are typically research facilities and are not designed for large scale screening of libraries. Combinatorial screening involves the high-throughput analysis of a large number of samples, typically 1000–100,000. Synchrotron facilities have a wide range of users and thus are designed for a wide range of experiments. Thus, access to a synchrotron for large scale screening of libraries is not practical.

It is highly desirable to do the x-ray screening in parallel with the processing of the libraries. This would require having deposition or processing equipment on site at a synchrotron facility. This is also not very feasible. Unlimited access to single or multiple laboratory x-ray sources combined with appropriate x-ray optics clearly has a distinct advantage due to their cost (i.e., a greater than 3 orders of magnitude reduction in instrument cost compared to a synchrotron facility), availability, and scalability. The use of synchrotrons, despite the difficulty, demonstrates the importance of X-ray analysis in evaluation of combinatorial libraries.

As noted, x-ray analysis on libraries has been performed using synchrotron x-ray beams. The power in an x-ray beam from a synchrotron (approximately $10^{11}$ photons/sec in a 1 mm spot) is at least three or more orders of magnitude larger than the power provided by a laboratory x-ray source (approximately $10^7$ photons/sec in a 1 mm spot). However, by coupling an appropriate x-ray optic to the laboratory source as proposed herein, adequate intensities (approximately $10^8$ photons/sec in a 100 $\mu$m spot) can be achieved to perform rapid screening on combinatorial libraries.

In this disclosure, a device is described for the controlled use of x-ray beams. Uses of x-ray beams include x-ray synthesis techniques, x-ray sensitive protecting groups, radiation damage effects for evaluation, and screening of libraries of different materials.

In one aspect of the invention, a laboratory based x-ray system is described that provides adequate power in a monochromatic or polychromatic focused or collimated beam. This device includes an x-ray laboratory source, x-ray optic and a detector for determining the structure, composition and/or valence state of any member of the library.

In another aspect, apparatus for characterizing materials are presented which include a laboratory x-ray source for emitting x-rays, and a combinatorial library. The combinatorial library is disposed so that at least a portion of the emitted x-rays impinge upon at least part of the library. A detector and an x-ray optic are also provided. The detector comprises one of an x-ray detector or an electron energy detector, and is disposed to detect x-rays or electron energy after the emitted x-ray has impinged upon the combinatorial library. The x-ray optic can be disposed between the laboratory x-ray source and the combinatorial library for capturing emitted x-rays from the laboratory x-ray source and directing the emitted x-rays to impinge upon the combinatorial library, or between the combinatorial library and the detector for capturing x-rays after impinging upon the combinatorial library and directing the x-rays to the detector.

The x-ray optic can comprise a polycapillary optic, a multilayer optic, a singly curved crystal, a doubly curved crystal or a grazing incidence single reflection optic, etc.

Methods for characterizing materials of a combinatorial library are also described and claimed herein.

Additional features and advantages are realized through the techniques of the present invention. Other embodiments and aspects of the invention are described in detail herein and are considered part of the claimed invention.

BRIEF DESCRIPTION OF THE DRAWINGS

The above-described objects, advantages and features of the present invention, as well as others, will be more readily understood from the following detailed description of certain preferred embodiments of the invention, when considered in conjunction with the accompanying drawings in which.

BEST MODE FOR CARRYING OUT THE INVENTION

Figure 1:
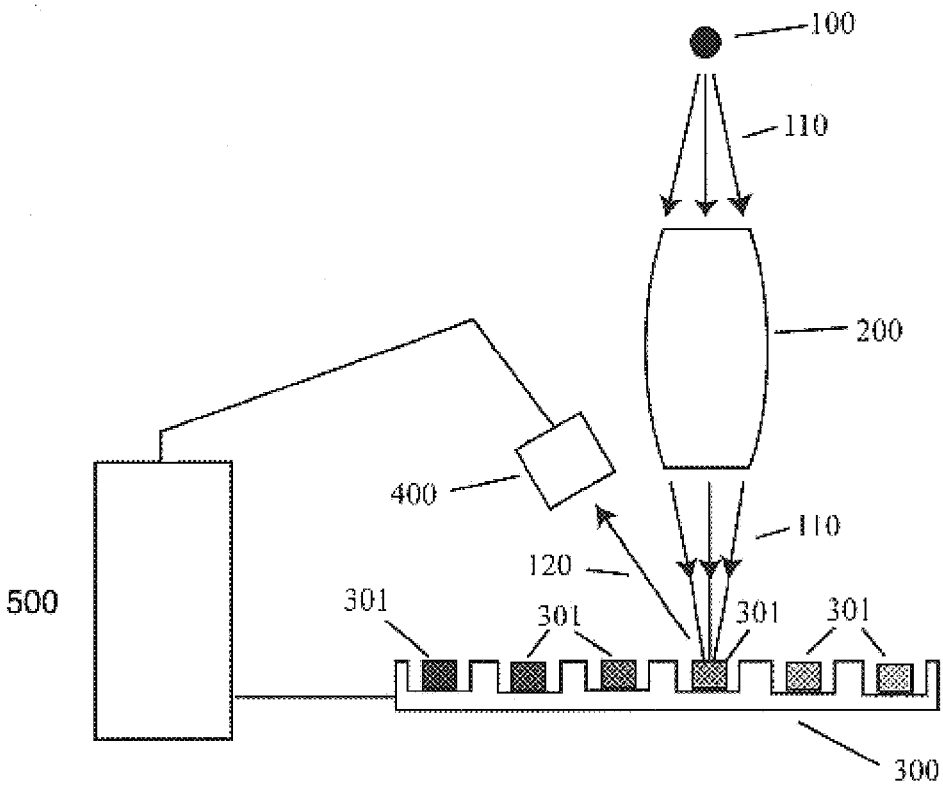
FIG. 1 is a schematic representation of an x-ray source, x-ray optic, combinatorial library, and a detector in accordance with the present invention. X-rays travel from the source, through the optic, to the sample where they are deflected and then detected.

X-ray optics are used to control X-rays from a source. High throughput experimentation typically involves a large number of samples. Therefore, it is highly desirable to perform and screen measurements as quickly as possible. In order to optimize x-ray screening for speed it is necessary to do one or more of the following:

- perform or screen experiments in parallel. increase the X-ray flux illuminating the sample.
- increase the X-ray flux of the post-sample signal reaching the detector.
- decrease the time spent on sample preparation by creating an appropriate X-ray beam (i.e., parallel beam for x-ray diffraction).
- decrease the sample size (typically microscale) to enable high throughput parallel preparation methods. This requires an area limitation of the probing X-ray beam. X-ray optics have the ability to increase the intensity gain of incident photons over a microscale pinhole collimator.

In accordance with the present invention, embodiments described herein address the ability to screen members of combinatorial libraries using X-ray analytical techniques that utilize a laboratory X-ray source and X-ray optics, examples of these techniques include X-ray diffraction, X-ray fluorescence, and X-ray reflectivity. One example where increasing the X-ray flux illuminating the sample greatly improves the ability to measure the X-ray fluorescence is shown. Increasing the X-ray flux is achieved by the addition of an X-ray optic such as a polycapillary focusing optic between a laboratory X-ray source and the combinatorial library. X-Ray fluorescence provides information about the combinatorial member's elemental composition and layer thickness if applicable. Another example where increasing the X-ray flux illuminating the sample greatly improves measurement time is X-ray diffraction. A polycapillary collimating optic or multilayer collimating optic may be used between the laboratory X-ray source and the combinatorial library to perform the measurement. Examples of the information provided by X-ray diffraction include phase identification, crystal properties, stress, crystallographic texture, and d-spacing.

An example where increasing the X-ray flux of the post-sample signal reaching the detector greatly improves the measurement time and measurement statistics is wavelength dispersive X-ray fluorescence (WDXRF). In this example, a collimating polycapillary optic and a flat crystal or flat multilayer are positioned between the combinatorial library and the detector. The X-ray signal from a member or members of a library is collected by the polycapillary optic which collimates the beam and directs it to the flat crystal or multilayer which reflects a particular wavelength that is directed to a detector. WDXRF gives information about elemental composition and layer thickness if applicable.

Sample preparation is often required for classical X-ray diffraction using the Bragg-Brentano geometry. Adding a collimating polycapillary optic, multilayer optic or curved crystal optic between the laboratory X-ray source and the combinatorial library allows parallel beam X-ray diffraction to be performed. Parallel beam X-ray diffraction eases the sample preparation such that a much wider variety of samples including rough, curved, and partially transparent samples can be measured without adverse effects on the measurement results. Therefore, sample preparation need not be a consideration for this type of measurement.

Focused beams from polycapillary focusing optics or multilayer focusing optics or curved crystal focusing optics allow X-ray fluorescence and convergent beam X-ray diffraction measurements to be performed on the small sample sizes of members in combinatorial libraries. Without the X-ray optics, the illumination area on the sample provided by the laboratory source is large and dependent on the distance between the library and the source and the reflected or transmitted signal includes information from multiple members of a library. With the optics, the spot size may be on the order of tens of microns.

X-rays may be controlled by absorption, elastic scattering or inelastic scattering. Typically, x-ray optics are used to accomplish these effects. In particular, this may involve one or more detailed processes, such as total X-ray reflection, crystal diffraction, refraction in matter, absorption (of divergent radiation or scattered radiation to select uniform X-rays), Raman X-ray scattering, fluorescence, interference and polarization. Polycapillary optics, for instance, are based on total multiple external reflections in arrays of glass capillaries. Doubly curved crystal optics use crystal diffraction from curved crystals to monochromatize and focus X-rays. Micro channel plates (MCP) use absorption to block the trajectories of X-ray photons in selected directions.

Typical implementations of controlled X-rays are collimation, monochromatization, energy tuning, focusing, and attenuation. Collimation can be achieved for example using a pin-hole aperture or a polycapillary optic. Monochromatization and energy tuning are achieved through interference effects or crystal diffraction. Focusing of x-rays is currently possible with polycapillary optics, tapered monocapillary optics, curved crystal optics, refracting optics or lobster eye optics. Attenuation of the x-ray beam is achieved by inserting an absorbing material in the path of the x-ray photons.

As proposed herein, x-ray optics enable the enhanced use of x-rays for applications related to combinatorial methods. Without optics, pinholes can be used to limit the illuminated area to the actual sample. By placing the pinhole and sample very close to the x-ray source the intensity loss is reduced. X-ray optics enable the use of condensed or focused x-ray beams to limit the area of illumination while simultaneously increasing the total flux in the reduced area. A convergent x-ray beam is not possible without x-ray optics. A convergent beam with intensity increase can also be used to provide multiple incident angles, which in some cases eliminates the need for moving parts.

FIG. 1 shows one embodiment of a device which can be used to analyze a member or members of a combinatorial library. An x-ray optic 200 intercepts an x-ray beam 110 from a source. The optic directs the x-ray beam 110 to a combinatorial library 300. The x-ray beam 110 may fall on a single member 301 of the library 300 or on multiple members of the library. After impinging upon the library, the x-ray beam 120 is collected by a detector 400.

A controller or processor 500 is connected to one or more of the x-ray source, x-ray optic, combinatorial library and detector, e.g., to control moving of the combinatorial library relative to the x-ray beam. The detector sends information to the controller to perform data analysis on the detected signal. Instead of the controller moving the combinatorial library, the laboratory source and x-ray optic might be moved by the controller to achieve the same motion of the x-ray beam relative to the combinatorial library. Although not shown other than in FIG. 1, controller 500 is assumed present in each of the apparatus embodiments depicted in the FIGS. and described below.

As one detailed example, a polycapillary optic 200 can be combined with a Cu-anode laboratory point source and used to focus x rays to a spot of approximately 50 microns on a member 301 of a combinatorial library containing variable quantities of Fe. The x-ray fluorescence signal is detected with an energy dispersive detector 400. Since the x rays are limited to a small area by the optic, there will be no fluorescent excitation in other members and the signal can be assumed to derive from a single member. The purpose of the polycapillary focusing optic is to collect X rays from the source and direct these X rays to a very small spot greatly increasing the flux (resulting in shorter measurement time) compared to the flux in the same area when a laboratory source is used alone. The following is a specific example where a polycapillary focusing optic provides benefit over pinhole collimation when placed before the sample. For a Trufocus 8050 copper anode x-ray source operating at 35 kV and 15 W coupled to a polycapillary focusing optic which has an effective collection solid angle of 0.0005 steradians and produces an output focal spot size of 50 $\mu$m(FWHM) and a Si(Li) detector produced by Noran Instruments, the gain compared to pinhole collimation is 2,000.

A focusing polycapillary optic, focusing multilayer optic, or curved crystal focusing optic may also be used between the laboratory X-ray source and combinatorial library as shown in FIG. 1 for convergent beam X-ray diffraction. The benefits of convergent beam X-ray diffraction are that no moving parts are needed because there are a number of different incident angles. The disadvantages include reduced precision as a result of beam broadening. However, for some measurements, the information provided by this technique is adequate. For example, in screening libraries, this technique could be used to determine whether crystalline phase is present or not.

More information about the X-ray analytical techniques described here can be found in the literature. For example, reference "Application of monolithic polycapillary focusing optics in MXRF," N. Gao, I. Yu. Ponomarev, Q. F. Xiao, W. M. Gibson, D. A. Carpenter, Appl. Phys. Lett., 69, 1529 (1996); "Enhancement of microbeam x-ray fluorescence (MXRF) analysis using monolithic polycapillary focusing optics," N. Gao, I. Yu. Ponomarev, Q. F. Xiao, W. M. Gibson, D. A. Carpenter, Appl. Phys. Lett., 71, 3441 (1997); "Parallel beam methods in powder diffraction and texture in the laboratory," R. A. Clapp and M. Haller, Advances in X-ray Analysis, Volume 43, in print; "Application of polycapillary optics for parallel beam powder diffraction," S. T. Misture and M. Haller, Advances in X-ray Analysis, Volume 43, in print; *Materials Science and Technology,* A Comprehensive Treatment, Volume 2 A Characterization of Materials Part 1, edited by R. W. Cahn, P. Haasen, E. J. Kramer, (VCH Verlagesgesellschaft mbH, Weinheim, Federal Republic of Germany & VCH Publishers Inc., New York, N.Y., 1992; *Quantitative X-ray Spectrometry,* Second Edition, Practical Spectroscopy Series, Volume 20, Ron Jenkins, National Centre for Diffraction Data, Newtown Square, Pa., R. W. Gould, University of Florida, Gainsville, Fla., Dale Gedke, EG&G ORTEC, Oak Ridge, Tenn., © Marcel Dekker, Inc., 1995; and *Handbook of X-Ray Spectrometry,* Methods and Techniques, Practical Spectroscopy Series, Volume 14, edited by Rene E. Van Grieken, Department of Chemistry, University of Antwerp, Antwerp, Belgium, Andrzej A. Markowicz, Institute of Physics and Nuclear Techniques, Academy of Minung and Metallurgy, Cracow, Poland, © Marcel Dekker, Inc., 1993.

Another embodiment of FIG. 1 where an X-ray optic before the library increases the flux to the member, is for the purpose of parallel beam X-ray diffraction measurements. In this case the there is a polycapillary collimating optic or multilayer collimating optic or curved crystal collimating optic between the laboratory source and the combinatorial library. Parallel beam X-ray diffraction provides phase identification, crystal properties and d-spacing information and avoids complicated sample preparation compared to the Bragg Brentano geometry which does not use an optic. Also, Bragg Brentano gets reasonable count rates by parafocusing from a large sample. As large samples are typically not available with combinatorial libraries, the count rate for Bragg Brentano would be extremely low. Parallel beam X-ray diffraction without optics is done with a pinhole with very limited effective solid angle and therefore low flux. The described method greatly increases the effective solid angle of the beam when used, therefore increasing the flux and greatly decreasing the data acquisition time. The following is a specific example where a polycapillary collimating optic provides benefit over pinhole collimation when placed before the sample. For an Oxford 5011 copper anode x-ray source operating at 50 kV and 50 W coupled to a polycapillary collimating optic which has an effective collection solid angle of 0.003 steradians and produces a 6 mm collimated beam and a Amptek detector, the gain compared to pinhole collimation is 240.

Figure 2:
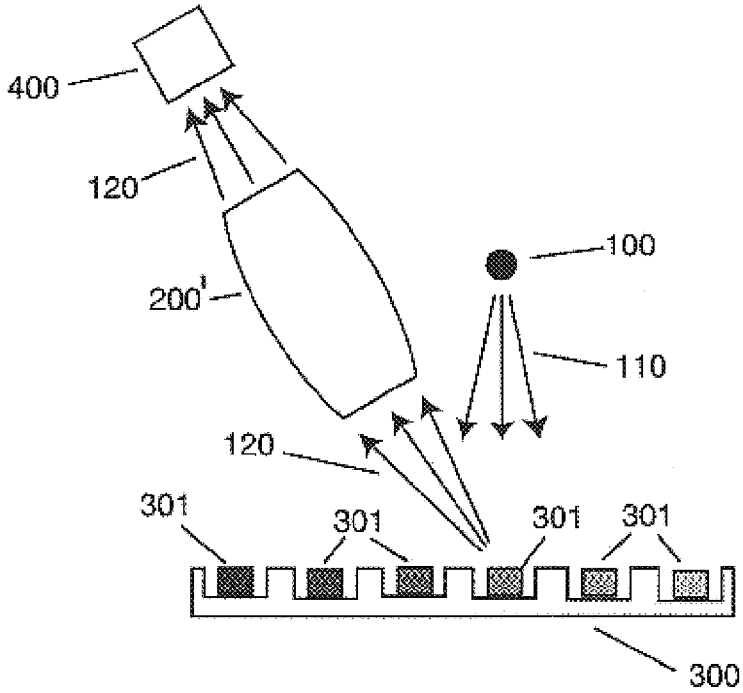
FIG. 2 is a schematic representation of an alternate embodiment of an x-ray source, combinatorial library, x-ray optic, and detector in accordance with the present invention. X-rays travel from the source, to the sample where they are deflected, through the optic and then detected.

FIG. 2 shows a similar device, however the optic 200 between the x-ray source and the combinatorial library 300 is omitted, and there is now an x-ray optic 200' between the library 300 and the detector 400. In this embodiment, x-ray beam 110 falls on a member 301 or members of the library 300, and x-ray beam 120 is thereafter collected by the x-ray optic 200' and directed to detector 400. One technique that uses this configuration is energy dispersive X-ray fluorescence where a polycapillary focusing optic or collimating optic is used between the library and the detector. The X-ray signal from the library is collected by the optic and directed to the energy dispersive detector. Without the optic, the measurement time is greatly increased and the signal captured by the detector includes signal from numerous members. The number of members that contribute depends on the capture angle of the detector which depends on the distance from the library to the detector. A second technique that uses this configuration is wavelength dispersive X-ray fluorescence where a multilayer or curved crystal focusing optic or collimating optic is used between the library and the detector. The X-ray signal from the library is collected by the optic and directed to the detector. Without the optic, the measurement time is greatly increased and the signal captured by the detector includes signal from numerous members. The number of members that contribute depends on the capture angle of the detector which depends on the distance from the library to the detector. Also, the optic provides a much higher energy resolution due to the monochromating nature of the multilayer and curved crystal optics. Using an optic provides increased count rates leading to shorter measurement times and provides specificity so that results can be evaluated from one or a selected limited number of members.

Figure 3:
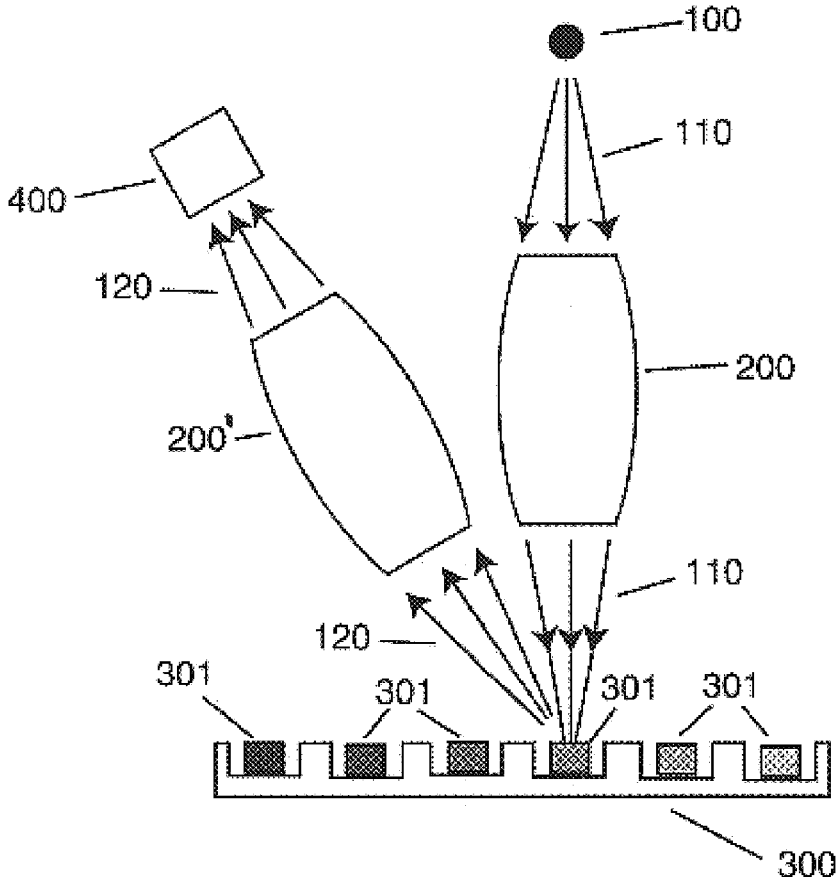
FIG. 3 is a schematic representation of another embodiment of an x-ray source, x-ray optic, combinatorial library, x-ray optic, and detector in accordance with the present invention. X-rays travel from the source, through the optic, to the sample where they are deflected, through the optic and then detected.

A similar device is again shown in FIG. 3. In this embodiment, two optics are used, one optic 200 is between the x-ray source and the combinatorial library 300 and a second optic 200' is between the library 300 and the detector 400. All of the techniques described for FIG. 1 and FIG. 2 can be applied to this configuration.

Figure 4:
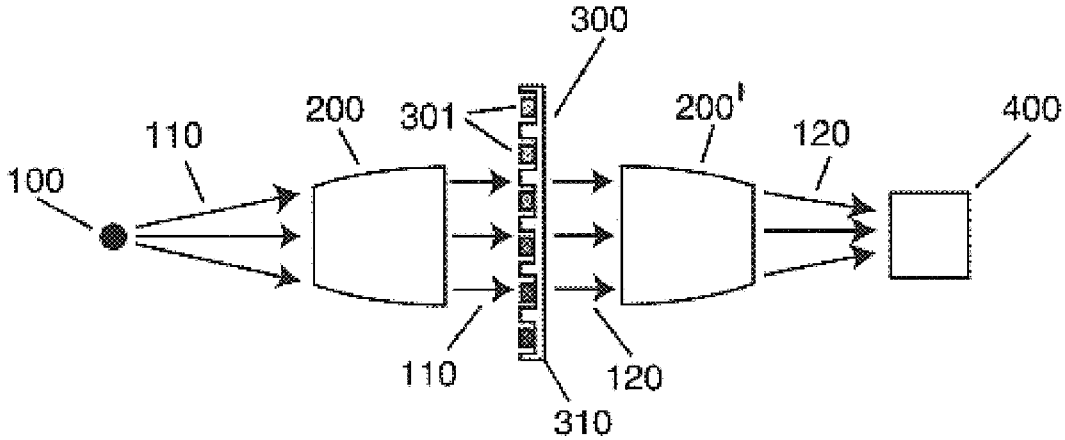
FIG. 4 is a schematic representation of still another embodiment of an x-ray source, x-ray optic, combinatorial library, x-ray optic and detector in accordance with the present invention. X-rays travel from the source, through the optic, to the sample where they are transmitted, through the optic and then detected.

A further alternate embodiment is shown in FIG. 4, focusing transmission mode X-ray diffraction may be employed using this configuration. In this example there is an x-ray source 100, an x-ray optic 200 such as a collimating multilayer optic or curved crystal collimating optic, a combinatorial library 300, a second x-ray optic 200' and a detector 400. X-ray beam 110 is intercepted by first optic 200 and directed to a member 301 or members of the library 300. The x-ray beam 110 is transmitted by the member 301 or members of the library. This x-ray beam 120 is collected by the second optic 200' and directed to a detector 400. In other embodiments of FIG. 4, a single optic may be used, i.e., either between x-ray source and the combinatorial library 300 or between the combinatorial library 300 and the detector 400. Similar to other X-ray diffraction techniques, phase identification, crystal properties and d-spacing may be determined. Providing a focused beam for this technique is not possible with a laboratory source alone, therefore, the optic is required to perform this measurement. This technique is useful for small volume samples. One example where this is used is placing material inside capillaries which may have diameters as small as tens or hundreds of microns. In any case, the substrate portion 310 of the library should be capable of transmitting x-rays. This is accomplished by the selection of a substrate material that transmits x-rays and by the selection of the material thickness to minimize absorption in the substrate. The combinatorial library may be a mixture of gases and therefore, it might be appropriate to discuss a holding tube instead of a substrate. It is also possible to have a combinatorial library that is a mixture of gases where the gas is flowing and a substrate is not present at all. Likewise, the combinatorial library could be a graded wire where the members of the library support themselves.

Figure 5:
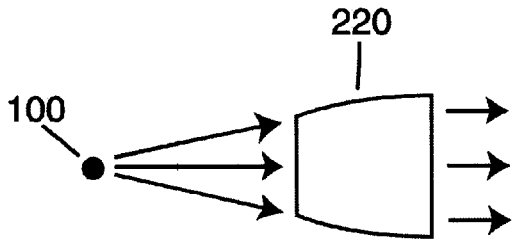
FIG. 5 is a schematic of a polycapillary collimating optic which can be used in an apparatus in accordance with the present invention.
Figure 6:
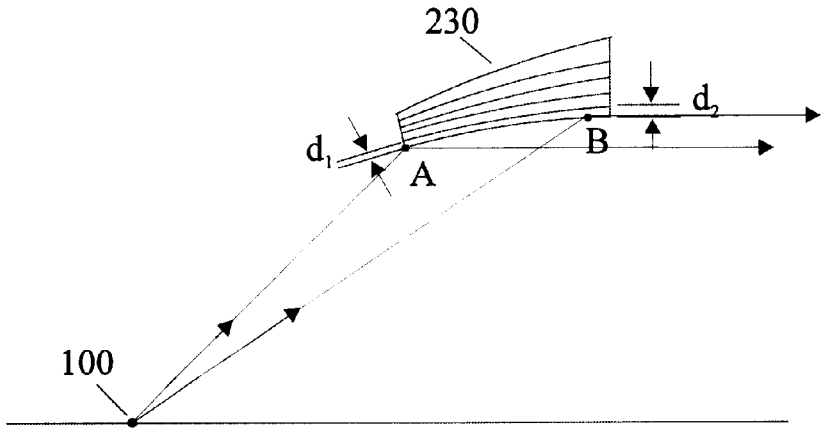
FIG. 6 is a schematic of a multilayer collimating optic which can be used in an apparatus in accordance with the present invention.
Figure 7:
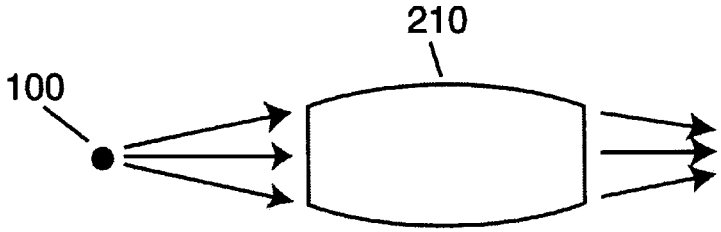
FIG. 7 is a schematic of a polycapillary focusing optic which can be used in an apparatus in accordance with the present invention.
Figure 8:
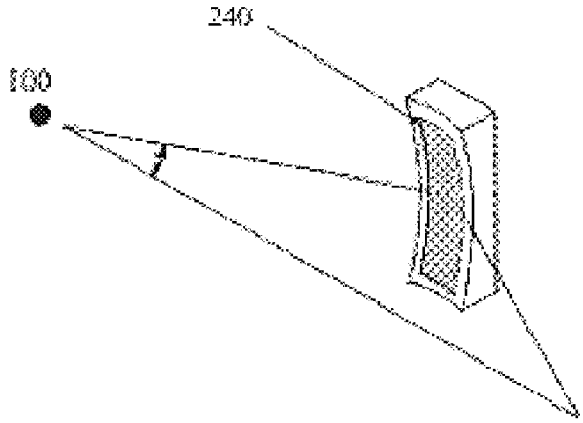
FIG. 8 is a schematic of a curved crystal focusing optic which can be used in an apparatus in accordance with the present invention.

The x-ray optic employed in the embodiments of FIGS. 1–4 may be a polycapillary collimating optic as shown in FIG. 5 or a multilayer collimating optic as shown in FIG. 6, where the x-ray beam 110 generated by the x-ray source 100 is collected by the x-ray optic 210 or 230, respectively, and is output as a parallel or quasi-parallel beam. Alternatively, the x-ray optic may be a polycapillary focusing optic as shown in FIG. 7 or a curved crystal focusing optic as shown in FIG. 8, wherein the x-ray beam 110 generated by the x-ray source is collected by the x-ray optic 220 or 240, respectively, and is output as a convergent beam that focuses to a small spot. Still further, the output beam from an x-ray optic may be divergent.

A range of beam spot sizes between 50 $\mu$m–6 mm can be produced by collimating optics such as those shown in FIG. 5 or FIG. 6, while a range of beam spot sizes between 10 $\mu$m–2 mm can be produced by focusing optics such as those shown in FIG. 7 or FIG. 8.

The x-ray optic described in the previous figures may be one of several types including a polycapillary optic, a multilayer optic, a singly or doubly curved crystal, a crystal monochromator, a channel cut crystal, a single reflection optic with a single metallic layer, a multichannel plate, or a monocapillary. For example, in the embodiment of FIG. 3 the x-ray optic before the combinatorial library 300 may be a polycapillary optic while the x-ray optic after the library may be a curved crystal or a multilayer optic. In addition, these optics may be either focusing or collimating.

Figure 9:
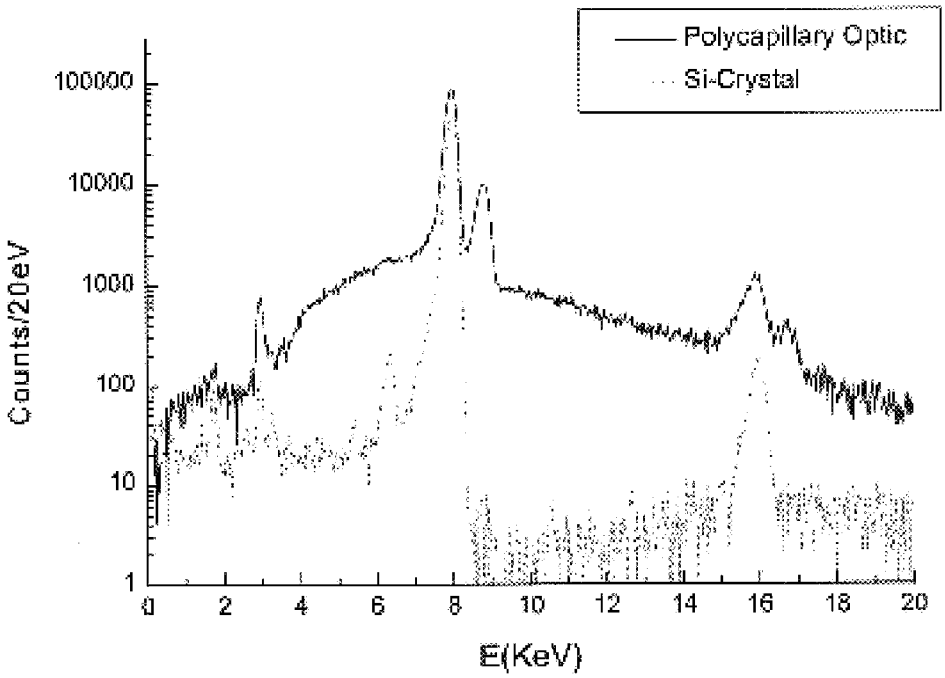
FIG. 9 is a graph of the energy spectrum transmitted by a polycapillary optic and a silicon crystal.

As a further example, the x-ray optics described above may provide a monochromatic beam in the case of a curved crystal or a polychromatic beam in the case of a polycapillary optic or a single reflection optic. FIG. 9 shows the spectrum transmitted by a polycapillary optic that transmits a polychromatic beam with an energy range between 4–10 keV and a doubly curved Si crystal which transmits a very narrow energy band depending on the design and the incident angle. For example, the energy bandwidth ($\Delta E/E$) of a silicon crystal (111) approximately $10^{-4}$.

The detector in the claimed invention may be one of several types including a Si(Li) detector, a Ge detector, a gas proportional counter, a charge coupled device (CCD), a charge injection device (CID), a multiwire area detector, an imaging plate, an amorphous silicon detector, or an electron energy analyzer.

In one embodiment, an analytical technique of x-ray fluorescence is used to determine elemental composition in a member or members of a combinatorial library. To implement this approach one might consider the apparatus in FIG. 1, FIG. 2, or FIG. 3 where the x-ray optic 200 on the x-ray source side is a focusing optic such as a polycapillary focusing optic which provides a spot size of 40 $\mu$m at 8 keV. On the detection side a collecting optic 200' may or may not be used. Because a polycapillary optic transmits a broad energy range, an energy dispersive detector may be used. Examples of an energy dispersive detector include a Si(Li) detector, Ge detector or microcalorimeter detector (such as described in U.S. Pat. No. 5,880,467).

In another embodiment utilizing x-ray fluorescence, the x-ray optic 200 on the x-ray source side can be a curved crystal focusing optic which provides a spot size as small as 10 $\mu$m. On the detection side, an optic 200' again may or may not be used. Because the curved crystal optic transmits a single energy, there are certain benefits to using a monochromatic beam incident on the sample. These include high sensitivity, one to two orders of magnitude lower background noise than polychromatic radiation, the ability to detect low concentrations and much simpler quantitative analysis. There can be certain drawbacks, however, including the ability to detect a limited number of elements, i.e., those which can be effectively excited by the narrower range of excitation wavelengths. Using this approach, an energy dispersive detector may be used or a wavelength dispersive approach may be taken which involves using a crystal optic between the combinatorial library and the detector where the crystal optic is tuned to transmit a single energy.

Figure 10:
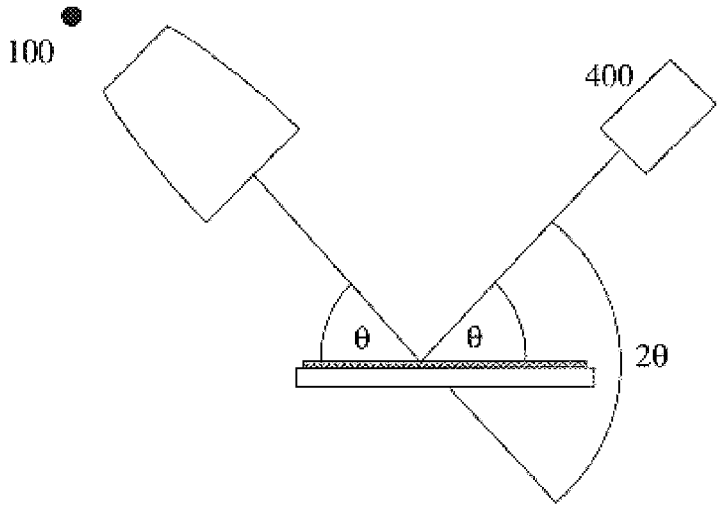
FIG. 10 is a schematic of the $\theta$–$2\theta$ relationship used in X-ray diffraction.

Another analytical technique involves x-ray diffraction which provides, among other things, structural and phase information about the members of the combinatorial library. In a preferred embodiment, the x-ray optic 200 on the x-ray source side in FIG. 1, 2, or 3 is a collimating optic 220 or a focusing optic 210. For some applications, the x-ray source and the x-ray optic 220 may be scanned in theta while the detector 400 and the optional x-ray optic 200' on the detector side are scanned in 2θ. An example of this arrangement is shown in FIG. 10 without the optic after the sample. Another embodiment involves keeping the source, detector, and optic (or optics) stationary. This embodiment can be configured to have no moving parts except those involved with changing the position of the combinatorial library relative to the x-ray equipment. This approach is called energy dispersive X-ray diffraction and uses energy analysis of the x-rays in exchange for moving parts. The detected signal can be either caused by diffraction or fluorescence or both.

Another technique to avoid moving the sample (or source and optic) and the detector is to use a position sensitive two dimensional detector. Given the small sample size, the position of the diffraction spots on the detector may be used to calculate the diffracted angles.

Another advantage of using an x-ray optic with a laboratory source on a combinatorial library is realized when only partial information from the x-ray analytical technique is needed for preliminary screening. Most x-ray analytical techniques require movement of the sample or detector or both. This movement is in addition to any movement required for positioning individual members of a library in an analyzing beam. Optics can provide multiple incident angles of x-ray beams. In the case of x-ray single crystal diffraction, it is necessary to position the diffracting crystal planes at an angle of theta, and the detector at an angle of 2-theta to the incident beam. Instead of rotating the crystal and the detector to the desired position it is also possible to provide multiple incident angles, one of which will match the diffraction conditions and result in a diffraction signal in the detector (or area detector). This method has a disadvantage, however, because accuracy is lost due to peak broadening and other effects when it is applied in the case of powder diffraction, for example. Therefore, the information gained may only be part of the information which can be obtained using the conventional method. However, this partial information will be sufficient in most cases to reduce the need for more detailed analysis. This is a significant advantage, because a detailed analysis is very time consuming and should be reserved only for the most promising library members. This technique collects information on all of the angles simultaneously, rather than scanning which is a serial process, thereby greatly decreasing the measurement time per library member. Also, it eliminates the need for a goniometer, the central component of an x-ray diffractometer and a very expensive part.

Figure 11:
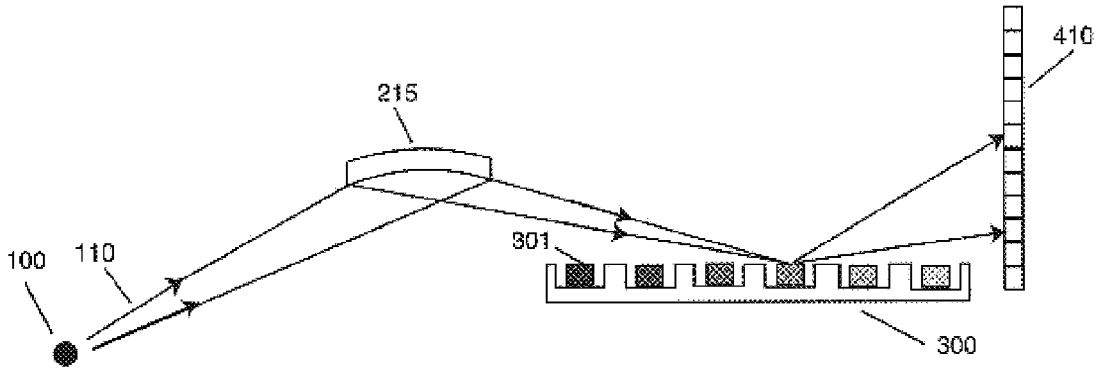
FIG. 11 is a schematic of an apparatus comprising an x-ray source, doubly-curved crystal, combinatorial library, and position sensitive detector in accordance with the present invention.

A third analytical technique in accordance with the present invention involves x-ray reflectivity. One embodiment of this technique is shown in FIG. 11. The x-ray beam 110 from the x-ray source is incident on a doubly curved crystal 215 or multilayer, which focuses the x-ray beam onto a member of the combinatorial library with the range of angles of incidence onto the member being slightly above and below the critical angle. The reflected x-ray beam is collected by a position sensitive detector 410. This type of measurement provides information about the surface roughness, density and layer thickness of the material. Also, in the case of multi-layers in the library, it provides information about the interface roughness and the thickness of the layers. X-ray reflectivity measurements require an optic such as a doubly curved crystal or a multilayer to monochromatize the beam. A laboratory X-ray source supplies a polychromatic beam. A monochromatizing optic such a curved crystal or a multilayer are required before or after the library in order to measure the intensity versus incident angle for discrete energies. This is not possible with a laboratory source alone. Also, using the convergent beam optic provides a range of angles simultaneously, decreasing time for measurement and avoiding the need to rock the sample or scan the source.

Figure 12:
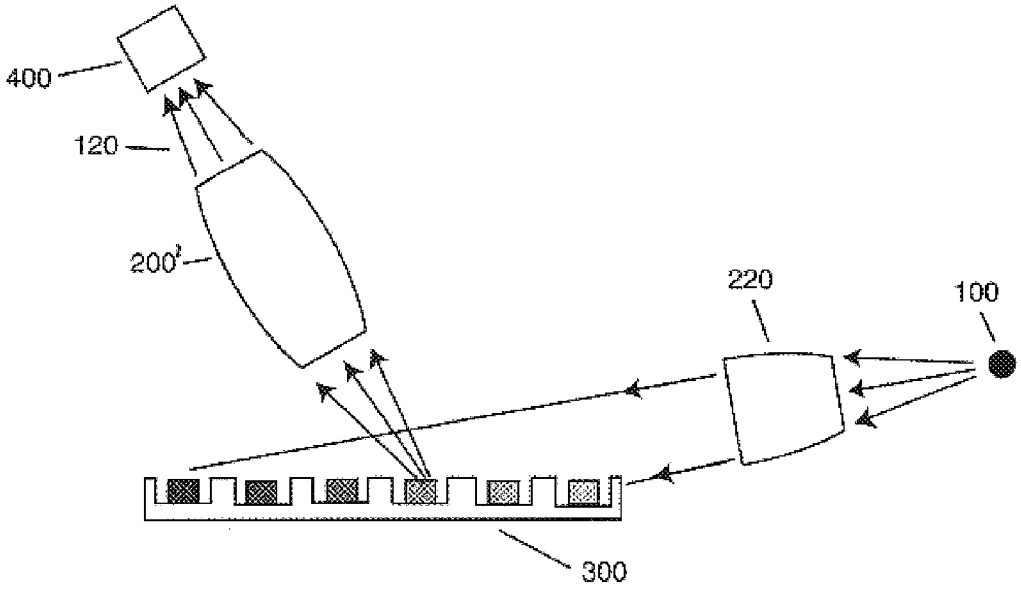
FIG. 12 is a schematic of an apparatus comprising an x-ray source, collimating x-ray optic, combinatorial library, focusing x-ray optic, and detector in accordance with the present invention.

Another useful analytical technique is shown in FIG. 12. In this example, a collimating optic 220 illuminates the combinatorial library with a collimated beam which illuminates an area that covers multiple members of the library. On the detection side, a focusing optic 200' collects the x-rays from individual members of the library. The incident angle is on the order of the critical angle. The focusing optic and detector may be scanned in 2θ and the combinatorial library may be moved in the plane parallel to the member surfaces.

Figure 13:
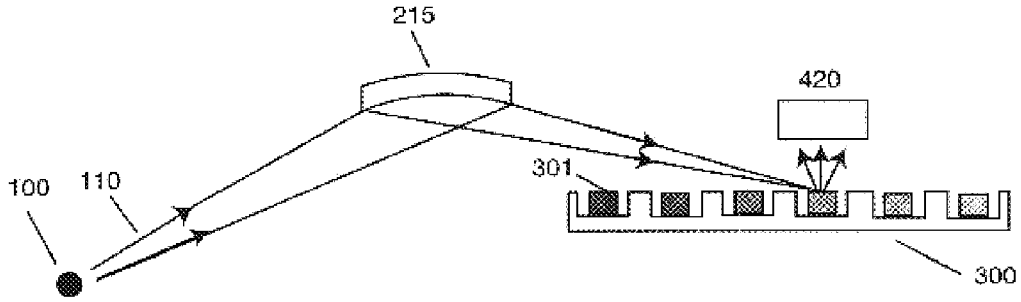
FIG. 13 is a schematic of an X-ray source, curved crystal collimating optic, combinatorial library and energy dispersive detector used in total reflection X-ray fluorescence.

In another embodiment of the present invention, the analytical technique of total reflectivity x-ray fluorescence (TRXRF) can be used to determine elemental composition of a member or members of a combinatorial library. This approach is analogous to x-ray fluorescence. This technique may be practiced using the configuration shown in FIG. 13. Advantageously, this approach employs an X-ray optic or an array of X-ray optics to provide a narrow parallel beam which intercepts the sample 300 at a low incident angle, typically a few seconds of arc. This technique provides surface sensitive low detection limit elemental composition. If an X-ray optic is used, the optic must be of the collimating type on the side where the X rays are incident on the sample and the X-ray optic may be a focusing polycapillary optic, a focusing singly or doubly curved crystal optic or a focusing multilayer optic on the collecting side of the sample. The fluorescence signal can be registered with an energy dispersive detector 420 above the sample. In other embodiments, the same basic set-up could be used to measure the diffraction signal or the extended X-ray absorption fine structure and the system would be a total reflection x-ray diffraction system (TRXRD) or REFLEXAFS.

In another embodiment, the analytical technique of extended X-ray absorption fine structure (EXAFS) is used to measure near range environments of atoms. In this example, an X-ray optic is used to selectively tune the X-ray energy from a continuous source and redirect the tuned X-ray incident beam on a member of a combinatorial library 300. The energy may be scanned by rocking the monochromator located before the sample. A different approach is to use a curved crystal optic before the sample. In some cases the rocking curve width of the crystal is large enough to cover a narrow energy bandwidth eliminating the need to rock the crystal. The technique is designed to provide information by scanning a small band of energy around the absorption edge of the material. The energy function before and after the sample is measured by X-ray detectors. This technique can be used to determine the atomic number, distance and coordination number of the atoms surrounding the element whose absorption edge is being examined.

X-ray absorption near edge structure (XANES) provides information about the core electrons and bonding info such as the energetics of virtual orbitals, electronic configuration and site symmetry.

Grazing Emission X-ray absorption spectroscopy is used when very low detection limits are required and is used for depth profiling analysis. This technique utilizes an X-ray optic such as a polycapillary optic to increase the intensity of the X rays illuminating the sample. Collection is limited to grazing angles. So this is analogous to TRXRF where the incident beam is limited to grazing angles and collection may be at any angle. This technique may be performed with a configuration similar to that shown in FIG. 13.

In still another embodiment, the X-ray optic 200 is used to control an X-ray beam for excitation of photoelectrons in a member of a combinatorial library 300. This analytical technique is known as X-ray photoelectron spectroscopy (XPS). In this embodiment, the measured signal is the energy of the photoelectrons, not the energy or intensity of the X-rays. The configuration in FIG. 1 shows how this technique may be implemented where there is an X-ray optic such as a collimating or focusing polycapillary curved crystal, or multilayer between the laboratory X-ray source and library and the detector is an electron energy analyzer. The addition of the optic before the library increases the incident X-ray intensity which increases the electrons given off by the sample, thereby decreasing the measurement time.

In most embodiments, a combinatorial library has been described herein as an array of microscale samples discontinuously placed on a substrate. The structures and methods described in this patent, however, also apply to other types of combinatorial libraries, for example, where the library is a continuously graded material or where the region of interest is smaller or larger than microscale, or where no substrate is involved. A member or members of a library is a localized area on a substrate that is, was, or is intended to be used for the formation of a specific material. The area of the predefined regions depends on the application and is typically smaller than about 5 $cm^2$. However, the predefined regions may be smaller than 1 $cm^2$, smaller than 1 $mm^2$, smaller than 0.5 $mm^2$, smaller than 10,000 $\mu m^2$, smaller than 1,000 $\mu m^2$, smaller than 100 $\mu m^2$, or even smaller than 10 $\mu m^2$. The sample may be condensed matter, liquid, gaseous, a plasma or in a critical state.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and, scope of the invention.

What is claimed is:

1. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a polycapillary optic.

2. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a doubly curved crystal.

3. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a polycapillary optic or a doubly curved crystal.

4. The apparatus of claim 3, wherein said x-ray optic focuses emitted x-rays to a spot less 100 microns in diameter.

5. The apparatus of claim 3 further comprising means for characterizing an elemental composition of at least one material within said combinatorial library.

6. The apparatus of claim 3 further comprising means for characterizing a crystalline phase of at least one material within said combinatorial library.

7. The apparatus of claim 3, wherein said x-ray optic comprises one of a focusing x-ray optic or a collimating x-ray optic.

8. The apparatus of claim 7, wherein said x-ray optic comprises a collimating optic, said collimating optic comprising one of a polycapillary collimating optic of a curved crystal collimating optic, wherein said x-ray optic facilitates parallel beam x-ray defraction.

9. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic focuses emitted x-rays to a spot less 100 microns in diameter.

10. Apparatus for characterizing materials, said apparatus comprising:

a laboratory x-ray source for emitting x-rays;

a combinatorial library; wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic is a grazing incidence single reflection optic, or a multilayer optic.

11. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said second x-ray optic focuses emitted x-rays to a spot less than 100 microns in diameter.

12. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said first x-ray optic comprises a polycapillary optic.

13. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said first x-ray optic comprises a doubly curved crystal.

14. Apparatus for characterizing materials, said apparatus comprising:

a laboratory x-ray source for emitting x-rays;

a combinatorial library; wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library, wherein said first x-ray optic comprises a polycapillary optic or a doubly curved crystal, and wherein the first x-ray optic comprises one of a first focusing x-ray optic or a first collimating x-ray optic, and wherein said second x-ray optic comprises one of a second focusing x-ray optic or a second collimating x-ray optic.

15. The apparatus of claim 14, wherein said first x ray optic comprises the first focusing x-ray optic and said second x-ray optic comprises the second focusing x-ray optic.

16. The apparatus of claim 14, wherein said first x ray optic comprises the first focusing x-ray optic and said second x-ray optic comprises the second collimating x-ray optic.

17. The apparatus of claim 14, wherein said first x ray optic comprises the first collimating x-ray optic and said second x-ray optic comprises the second focusing x-ray optic.

18. The apparatus of claim 14, wherein said first x ray optic comprises the first collimating x-ray optic and said second x-ray optic comprises the second collimating x-ray optic.

19. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said first x-ray optic is a grazing incidence single reflection optic, or a multilayer optic.

20. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said second x-ray optic is a polycapillary optic.

21. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said second x-ray optic is a doubly curved crystal.

22. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library;

wherein said x-ray optic comprises a first x-ray optic, and wherein said apparatus further comprises a second x-ray optic for capturing x-rays after impinging upon said combinatorial library; and wherein said second x-ray optic is a grazing incidence single reflection optic, or a multilayer optic.

23. Apparatus for characterizing materials, said apparatus comprising:

a laboratory x-ray source of power approximately less than a few hundred watts for emitting x-rays;

a combinatorial library, wherein said combinatorial library is disposed so that at least a portion of said emitted x-rays impinge upon at least part of said library;

a detector, said detector being disposed to detect x rays or electron energy after said emitted x-rays have impinged upon said combinatorial library; and an x-ray optic disposed between said laboratory x-ray source and said combinatorial library for capturing emitted x-rays from said laboratory x-ray source and directing said emitted x-rays to impinge upon said combinatorial library, wherein said x-ray optic comprises a focusing optic for focusing emitted x-rays to impinge upon at least part of the combinatorial library.

24. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x-rays or electron energy after said emitted x-rays have impinged upon said combinatorial library; and an x-ray optic disposed between said combinatorial library and said detector for capturing x-rays from said laboratory x-ray source after impinging upon said combinatorial library;

wherein said x-ray optic comprises a polycapillary optic.

25. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x-rays or electron energy after said emitted x-rays have impinged upon said combinatorial library; and an x-ray optic disposed between said combinatorial library and said detector for capturing x-rays from said laboratory x-ray source after impinging upon said combinatorial library;

wherein said x-ray optic comprises a doubly curved crystal.

26. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x-rays or electron energy after said emitted x-rays have impinged upon said combinatorial library; and an x-ray optic disposed between said combinatorial library and said detector for capturing x-rays from said laboratory x-ray source after impinging upon said combinatorial library;

wherein said x-ray optic comprises a polycapillary optic or a doubly curved crystal.

27. The apparatus of claim 26, wherein said x-ray optic comprises one of a focusing x-ray optic or a collimating x-ray optic.

28. The apparatus of claim 26, wherein said x-ray optic focuses emitted x-rays to a spot less 100 microns in diameter.

29. The apparatus of claim 26, wherein said laboratory source comprises a low power x-ray laboratory source.

30. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x-rays or electron energy after said emitted x-rays have impinged upon said combinatorial library; and an x-ray optic disposed between said combinatorial library and said detector for capturing x-rays from said laboratory x-ray source after impinging upon said combinatorial library;

wherein said x-ray optic is a grazing incidence single reflection optic, or a multilayer optic.

31. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x-rays or electron energy after said emitted x-rays have impinged upon said combinatorial library; and an x-ray optic disposed between said combinatorial library and said detector for capturing x-rays from said laboratory x-ray source after impinging upon said combinatorial library;

wherein said x-ray optic focuses emitted x-rays to a spot less than 100 microns in diameter.

32. Apparatus for characterizing materials, said apparatus comprising:

a laboratory x-ray source for emitting x-rays;

a combinatorial library, wherein said combinatorial library is disposed so that at least a portion of said emitted x-rays impinge upon at least part of said library;

a detector, said detector being disposed to detect x-rays or electron energy after said emitted x-rays have impinged upon said combinatorial library; and an x-ray optic disposed between said combinatorial library and said detector for capturing x-rays from said laboratory x-ray source after impinging upon said combinatorial library;

wherein said x-ray optic comprises a focusing optic, said focusing optic capturing x-rays from the laboratory x-ray source after impinging upon said combinatorial library and focusing said x-rays to impinge upon the detector.

* * * * *